US007462068B2

(12) United States Patent
Amidon

(10) Patent No.: US 7,462,068 B2
(45) Date of Patent: Dec. 9, 2008

(54) SURE-GRIP RCA-TYPE CONNECTOR AND METHOD OF USE THEREOF

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/695,666

(22) Filed: Apr. 3, 2007

(65) Prior Publication Data

US 2008/0248688 A1 Oct. 9, 2008

(51) Int. Cl.
*H01R 9/05* (2006.01)

(52) U.S. Cl. ..... 439/578

(58) Field of Classification Search ..... 439/578, 439/675, 851, 858, 583, 352, 668
See application file for complete search history.

(56) References Cited

U.S. PATENT DOCUMENTS

| | | | | |
|---|---|---|---|---|
| 1,669,013 | A | 5/1928 | Nowosielski | |
| 2,390,852 | A | 12/1945 | Stee | |
| 4,270,832 | A | 6/1981 | Tanabe | |
| 4,932,897 | A * | 6/1990 | Lee et al. | 439/578 |
| D320,192 | S * | 9/1991 | Sisk | D13/133 |
| D323,643 | S | 2/1992 | Lee | |
| 5,376,022 | A | 12/1994 | Carr et al. | |
| D366,862 | S | 2/1996 | Lee | |
| D366,863 | S | 2/1996 | Lee | |
| 5,529,513 | A * | 6/1996 | Lee | 439/491 |
| D371,762 | S | 7/1996 | Lee | |
| D374,862 | S | 10/1996 | Lee | |
| D376,580 | S | 12/1996 | Lee | |
| D400,171 | S | 10/1998 | Nimpoeno et al. | |
| 5,915,995 | A | 6/1999 | Meyer et al. | |
| D414,462 | S | 9/1999 | Peterson et al. | |
| 5,964,623 | A * | 10/1999 | Maher et al. | 439/668 |
| 6,296,526 | B1 | 10/2001 | Hussaini et al. | |
| D450,297 | S | 11/2001 | Lee | |
| 7,001,220 | B2 * | 2/2006 | Thorner et al. | 439/675 |
| D528,507 | S | 9/2006 | Brown et al. | |
| 7,153,159 | B2 * | 12/2006 | Burris et al. | 439/578 |
| 2007/0212922 | A1 * | 9/2007 | Montena et al. | 439/352 |

* cited by examiner

*Primary Examiner*—Chandrika Prasad
(74) *Attorney, Agent, or Firm*—Schmeiser, Olsen & Watts

(57) ABSTRACT

A sure-grip RCA-type coaxial cable connector is provided, wherein the connector comprises a connector body having an external surface upon which at least two gripping rings are securely located. Friction-enhancing surface features are positioned upon at least a portion of the external surface of the connector body between at least two of the gripping rings. Sure-grip fastening of the connector to an interface port is provided by gripping the connector so as to engage the gripping rings and the friction-enhancing surface features while maneuvering the connector onto an interface port.

20 Claims, 4 Drawing Sheets

SURE-GRIP RCA-TYPE CONNECTOR AND METHOD OF USE THEREOF

BACKGROUND OF INVENTION

1. Technical Field

This invention relates generally to the field of connectors for coaxial cables. More particularly, this invention provides for a RCA-type connector having an outer surface configured to facilitate sure-gripping of the connector and a corresponding method of use thereof.

2. Related Art

Cable communications have become an increasingly prevalent form of electromagnetic information exchange and coaxial cables are common conduits for transmission of electromagnetic communications. Accordingly, coaxial cables are provided to facilitate communication exchange in a variety of applications and environments. In addition, various cable connectors are provided to facilitate connection of cables to various interface ports. An RCA-type connector is a common connector available for connecting coaxial cables to RCA-type interface ports.

For an RCA-type connector to work properly, it is essential that the connector be properly mated to an interface port. However, as cable communications have become increasingly prevalent, the design and placement of interface ports has lead to increased difficulty in easily accessing the interface ports for efficient mating with typical RCA-type connectors. Hence, standard RCA-type connector designs are ineffective in assuring that an RCA-type connector may be securely gripped by a user to facilitate proper mating of the connector with a corresponding interface port.

Accordingly, there is a need in the field of RCA-type coaxial cable connectors for an improved connector design.

SUMMARY OF INVENTION

The present invention provides an apparatus for use with coaxial cable connections that offers improved reliability.

A first general aspect of the invention provides an RCA-type connector comprising: a mating end and opposing cable insertion end; and a connector body extending between the mating end and cable insertion end; wherein a portion of an exterior surface of the connector body includes friction-enhancing surface features located between a first gripping ring and a second gripping ring, said first and second gripping rings being externally positioned on the connector body.

A second general aspect of the invention provides a sure-grip RCA-type coaxial cable connector comprising: a connector body having an external surface upon which at least two gripping rings formed of rubber-like material are securely located; and friction-enhancing surface features positioned upon at least a portion of the external surface of the connector body between at least two of the gripping rings.

A third general aspect of the invention provides a connector comprising: an RCA-type mating end and an opposing cable insertion end; a connector body having an external surface upon which at least a first gripping ring and a second gripping ring are securely located; and means for enhancing the surface friction pertinent to a portion of the external surface of the connector body intermediate the first and second gripping rings.

A fourth general aspect of the invention provides a method for fastening an RCA-type connector to an interface port, said method comprising: providing a connector, including a mating end and opposing cable insertion end, and a connector body having an external surface upon which a first gripping ring and a second gripping ring are securely located, wherein a portion of the exterior surface of the connector body includes friction-enhancing surface features located between the first and second gripping rings; securely fastening a coaxial cable to the cable insertion end; gripping the connector so as to engage the gripping rings and the friction-enhancing surface features; and maneuvering the connector onto an interface port while maintaining a sure grip on the connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
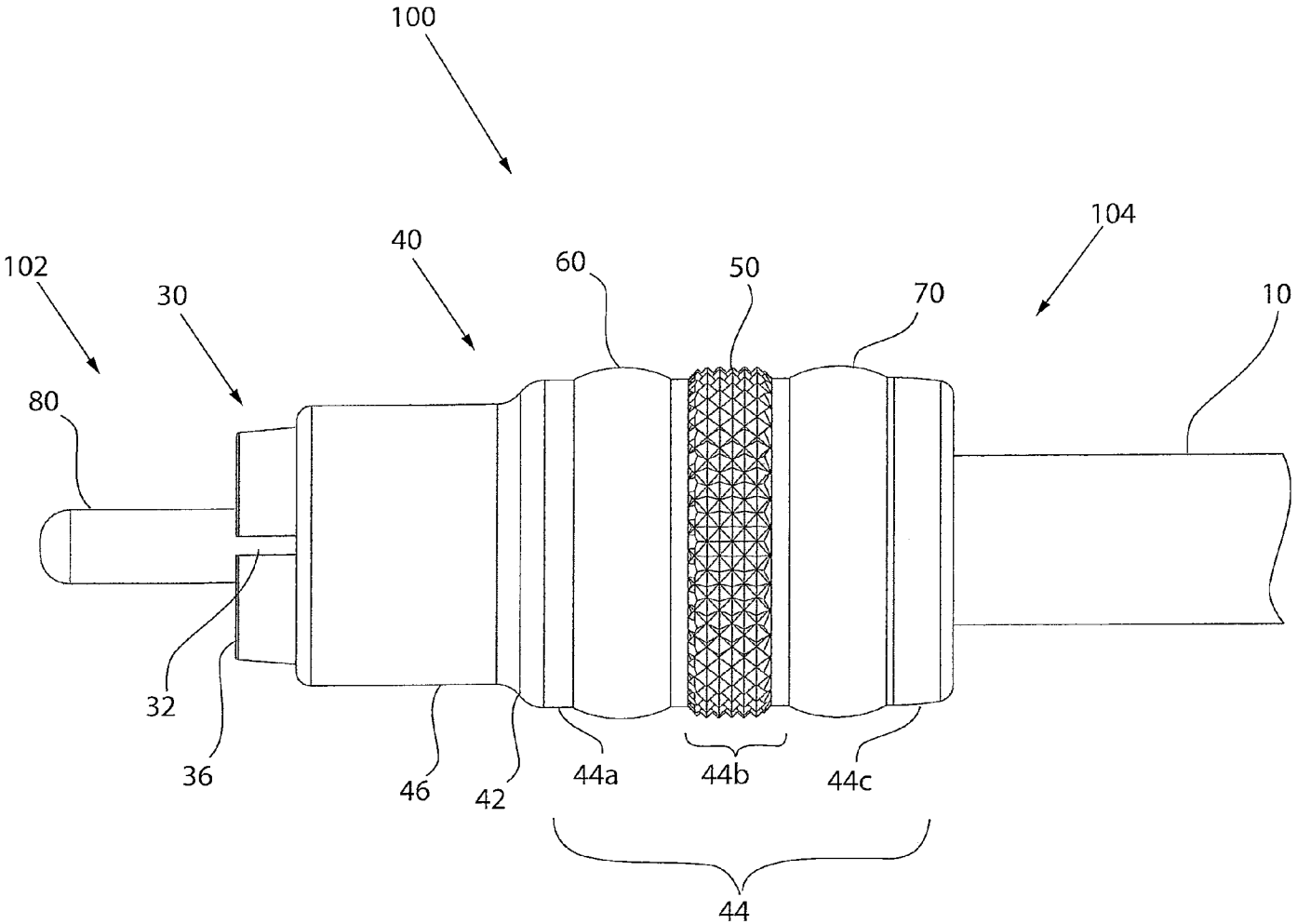
FIG. 1 depicts a side view of an embodiment of a sure-grip RCA-type connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms “a”, “an” and “the” include plural referents, unless the context clearly dictates otherwise.

Referring to the drawings, FIG. 1 depicts a side view of an embodiment of a sure-grip RCA-type connector 100, having a mating end 102 and a cable insertion end 104. Accordingly, the connector 100 may operate with a coaxial cable 10. The coaxial cable 10 may be prepared and securely connected with the connector 100. For example, the coaxial cable 10 may be prepared as embodied in FIG. 2 by removing a protective outer jacket 12 and drawing back a conductive grounding shield 14 to expose a portion of an interior dielectric 16. Further preparation of the embodied coaxial cable 10 may include stripping the dielectric 16 to expose a portion of a center conductor 18. The protective outer jacket 12 may be provided to protect the various components of the coaxial cable 10 from damage which may result from exposure to dirt or moisture and from corrosion and may be formed of various materials suitable for accomplishing the intended protection. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to preventingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional coaxial cable communications standards, installation methods and/or equipment. Moreover, the cable 10 may include a flooding compound or viscous sticky moisture inhibitor to prevent the capillary migration of water inside the cable 10 should a puncture or other leak occur and depending upon the performance requirements for the cable 10. It should further be recognized that the radial thickness of the coaxial cable 10, protective outer jacket 12, conductive grounding shield 14, interior dielectric 16 and/or center conductor 18 may vary based upon generally recognized parameters corresponding to coaxial cable communication standards and/or equipment.

The cable 10 may be securely inserted into the cable insertion end 104 and firmly attached to the connector 100. The secure attachment of the cable 10 to the connector 100 may be facilitated through various means such as crimping, threading, compressing, snagging, squeezing or other like means that may be employed to firmly fasten the cable 10, as inserted in the cable insertion end 104, into operable position with the connector 100. The cable 10 may be tightly disposed in the insertion end 104. The tight disposition of the cable 10 within the insertion end 104 may provide a traction force helpful in preventing the cable 10 from pulling out of the connector 100. Moreover, the snug placement of the cable 10 within the insertion end 104 may provide a substantially uniform circular distribution of grasping force on the cable 10 and may facilitate a secure and substantially sealed binding of the cable 10 to the connector 100. Accordingly the cable 10 may be securely fastened to the connector 100 in such as way as to stop environmental contaminants or electromagnetic noise from entering into the connector 100.

Figure 2:
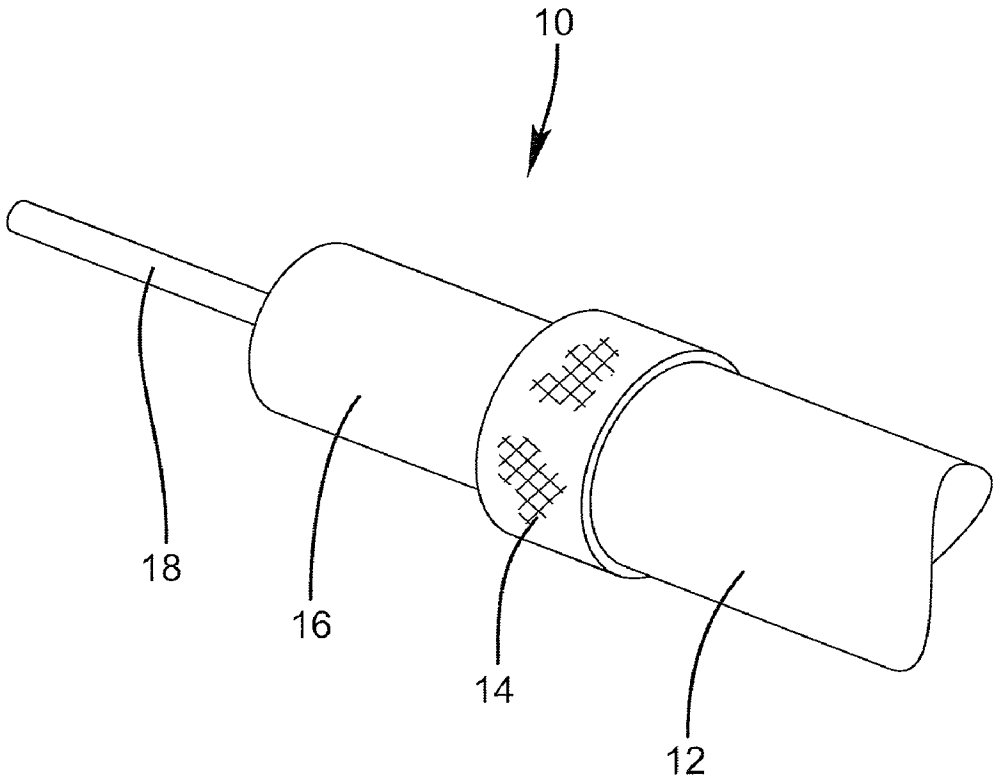
FIG. 2 depicts a perspective view of an embodiment of a coaxial cable, in accordance with the present invention.
Figure 3:
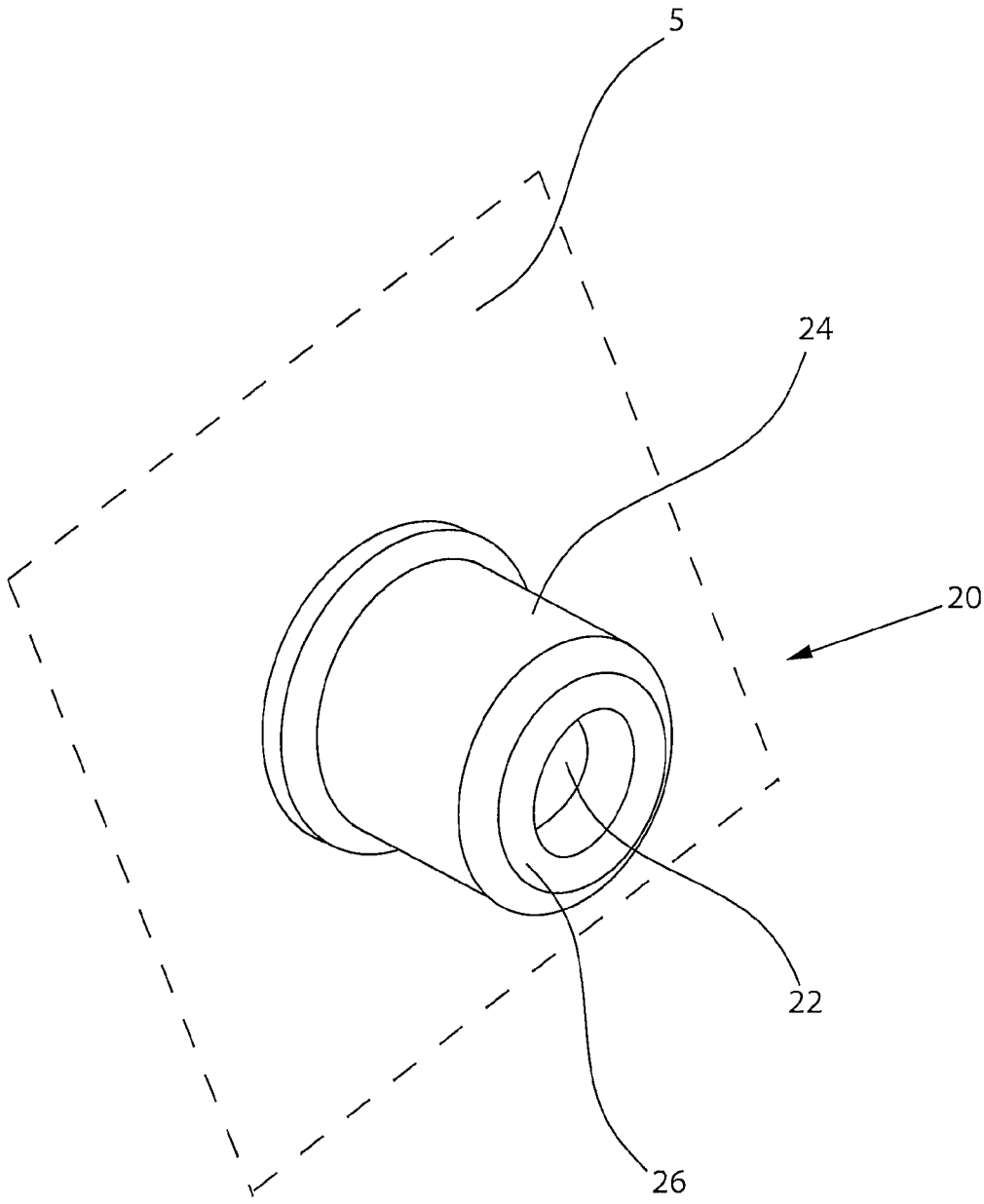
FIG. 3 depicts a perspective view of an embodiment of an RCA-type interface port, in accordance with the present invention.

With continued reference to FIGS. 1-2 and further reference to FIG. 3, the mating end 102 of connector 100 may operate with an RCA-type interface port 20. The interface port 20 may be mounted on or integrated with a face 5 of an electrical component such as a television, a VCR, a DVD-player or other electrical components utilizing RCA-type communications ports. Moreover, the interface port may be configured as a female port of a connector apparatus for various RCA-type communications devices such as S-video adapters, VGA adapters, SCART adapters, line-extenders, line-splitters, and/or any other device(s) having an RCA-type port. The RCA-type interface port 20 may include a receptacle 22 for physically receiving and making electrical contact with a portion of a center pin 80 of connector 100, wherein the center pin 80 may be in electrical contact with the center conductor 18 of the coaxial cable 10. Within the receptacle 22 may be a bushing 26 configured to facilitate secure physical and electrical contact between the receptacle 22 and center pin 80 of connector 100. The bushing may be formed of insulating materials and may be color coded according to typical RCA-type cable communications standards.

Figure 4:
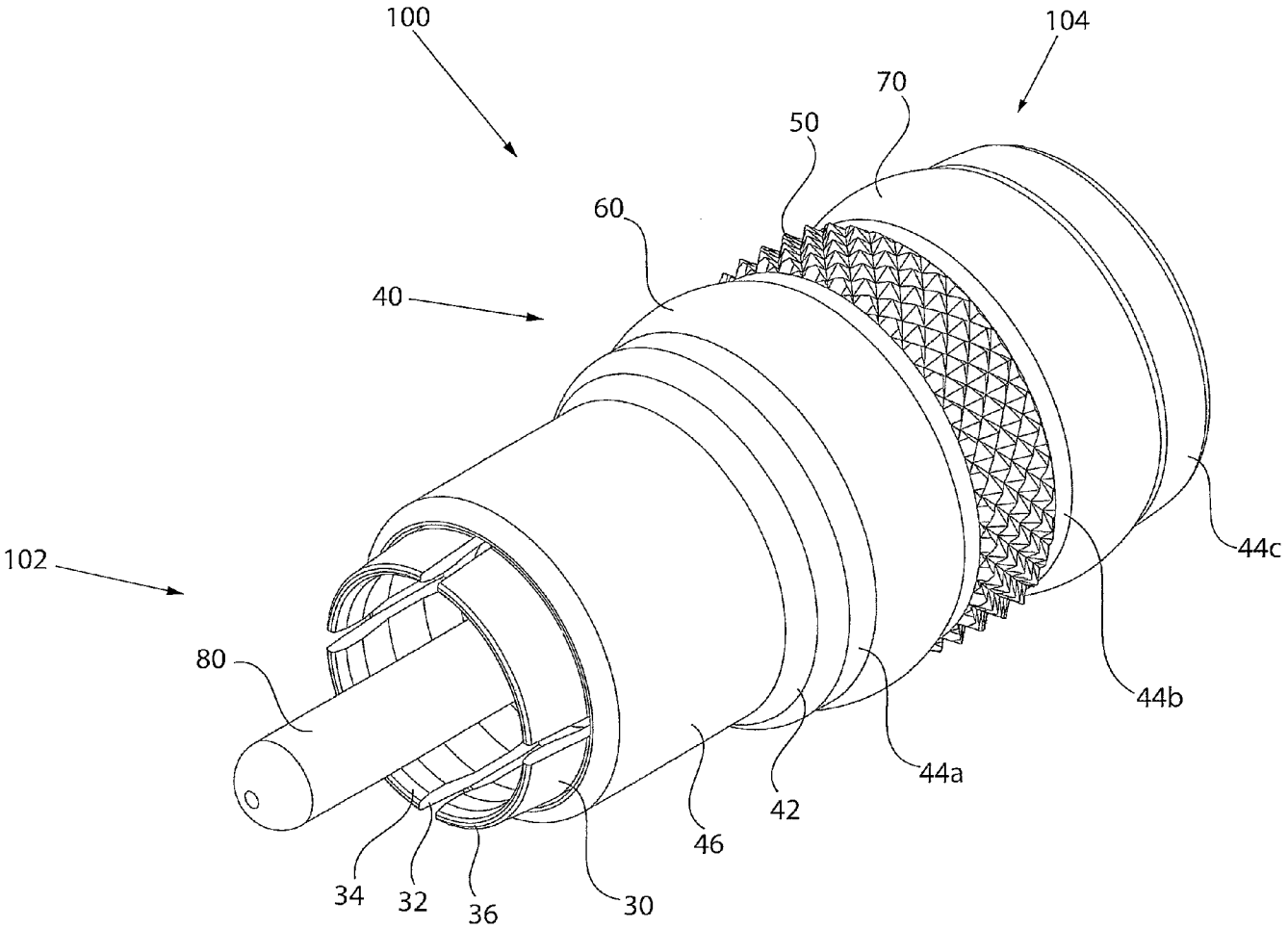
FIG. 4 depicts a perspective view of an embodiment of a sure-grip RCA-type connector, in accordance with the present invention.

The interface port 20 may further comprise an exterior surface 24, wherein the exterior surface may be configured to physically and electrically contact a shielding ring 30 of connector 100. The physical and electrical contact of the exterior surface 24 with the shielding ring 30 of the connector 100 may prevent electrical noise and other environmental contaminants from disrupting the communications connection between the connector 100 and the port 20. The exterior surface 24 of the RCA-type interface port 20 may be configured to facilitate a friction fit with the shielding ring 30 of the mating end 102 of connector 100. As depicted in FIG. 4, the shielding ring 30 may include a mating end 36 having an internal chamfer 34. Moreover, the shielding ring may be partially segmented into flexible sections by slits 32. Accordingly, the mating edge 36 of the shielding ring 30 may be compressed over the end of the interface port 20, as assisted by the chamfer 34 and may flex to accommodate snug maneuvering of the shield onto and over the external surface 24 of the interface port 20. It should be recognized that the radial thickness and/or the length of the RCA-type interface port 20 may vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 physical and/or electrical interface with a connector 100.

Referring still further to FIGS. 1-3 and with additional reference to FIG. 4, an embodiment of the connector 100 may comprise a connector body 40. The connector body 40 may extend between the mating end 102 and cable insertion end 104 and may encase at least a portion of the shielding ring 30 at the mating end 102 of the connector 100. Moreover, the connector body 40 may serve to house, in some manner, a portion of a cable 10 that may be securely fastened to the connector 100 at the cable insertion end 104. Furthermore, the connector body 40 may be cylindrical or tube-like and may include various portions having differing diameters. For example, the connector body may include a first body portion 46 having an external surface diameter that is smaller than a second body portion 44. A transition body portion 42 may be located between the first body portion 46 having the smaller diameter and the second body portion 44 having the larger diameter. The connector body 40 may be formed of materials such as, polymers, metals or composite materials. Further, the connector body 40 may be formed of conductive or non-conductive materials or a combination thereof. In addition, various portions of the connector body 40 may be formed of different materials. Manufacture of the connector body 40 may include casting, extruding, cutting, turning, drilling, injection molding, spraying, blow molding, gluing, welding, or other fabrication methods that may provide efficient production of the component.

With continued reference to the drawings, a connector 100 may include a first gripping ring 60. The first gripping ring 60 may be securely located upon an external surface of the connector body 40. For example, the first gripping ring 60 may be positioned near the transition portion 42 of the connector body 40 so that a small residual section **44*a* of the second body portion 44 of the external surface of the connector body 40 is exposed between the transition portion 42 and the first gripping ring 60. The first gripping ring 60 may be formed of a rubber-like, stretchable, malleable material that may be pulled or stretched tightly over the external surface of the connector body 40. The tight disposition of the first gripping ring 60 on the connector body 40 may facilitate a firm position of the ring 60 with respect to the body 40. Moreover, the first gripping ring 60 may be seated in an annular groove, channel, slot, or notch (not shown) that may further assist the ring 60 in maintaining a secure position upon the external surface of the connector body 40. The connector 100 may also include a second gripping ring 70. The second gripping ring 70 may also be securely located upon an external surface of the connector body 40. For example, the second gripping ring 70 may be positioned toward the cable insertion end 104 of connector 100 on the connector body 40 so that a small end section 44***c* of the second body portion 44 of the external surface of the connector body 40 is exposed between the cable insertion end 104 and the second gripping ring 70. The second gripping ring 70 may likewise be formed of a rubber-like, stretchable, malleable material that may be pulled or stretched tightly over the external surface of the connector body 40. The tight disposition of the second gripping ring 70 on the connector body 40 may facilitate a firm position of the ring 70 with respect to the body 40. Moreover, the second gripping ring 70 may, like the first gripping ring 60, be seated in an annular groove, channel, slot, or notch (also not shown) that may further assist the ring 70 in maintaining a secure position upon the external surface of the connector body 40. A connector 100 may comprise a connector body 40 having an external surface upon which at least two gripping rings 60/70 formed of rubber-like material may be securely located. Additionally, friction-enhancing surface features 50 may be positioned upon at least a portion, such as intermediate section 44*b*, of the external surface of the connector body 40 between at least two of the gripping rings 60/70.

Between the first gripping ring 60 and the second gripping ring 70 may be an intermediate section 44*b* of the second portion 44 of the external surface of the connector body 40. Located on this intermediate section 44*b* may be friction-enhancing surface features 50. The friction-enhancing surface features 50 may be a knurled portion of the external surface of the connector body 40, or the friction-enhancing surface features 50 may be a series of annular ridges, lips or rims, protrusions, bumps, bulges, juttings, protuberances, knobs, castellations, and/or other like features extending outwardly from the external surface of the connector body 40. Moreover, the friction-enhancing features 50 may be dimples, slots, grooves, channels, rows, craters, bowls, and/or other like features extending inwardly from the external surface of the connector body 40. Furthermore, the friction-enhancing surface features 50 may be a combination of features, which may extend both inwardly and/or outwardly from the external surface of the connector body 40, as described above or other similar features. The entire intermediate section 44*b* of the second portion 44 of the external surface of the connector body 40 located between the first 60 and second 70 gripping rings does not need to include friction-enhancing surface features 50. Nevertheless, a portion of the intermediate section 44*b* should contain surface features 50 which increase friction of the surface of the connector body 40 helping to provide an improved grip-ability of the connector 100. In other words, the friction-enhancing surface features 50 may boost the amount of force necessary to slide the connector 100 out from a grip engaging the surface features 50 between gripping rings 60/70. It should also be recognized that the intermediate section 44*b* may include multiple or separate surface portions of friction-enhancing surface features 50. For example, the intermediate section 44*b* may include two bands of knurling separated by a smooth annular segment of the surface of the connector body 40. The friction-enhancing surface features 50 may be formed integrally with the connector body 40, or may be fashioned onto the connector body through cutting, knurling, turning, milling, drilling, gluing, welding, thermally deforming, or through other like means.

One or each of the first 60 and the second 70 gripping rings may have an axial width slightly larger than an axial width corresponding to the portion of the intermediate section 44*b* of the external surface of the connector body 40 including friction-enhancing surface features 50. Although the first and second gripping rings 60 and 70, depicted in FIGS. 1 and 4, are shown having smooth outer surfaces, it should be recognized that the rings 60/70 may themselves also include friction-enhancing surface features. For example, a gripping ring 60/70 may include knurling, a series of annular ridges, lips or rims, protrusions, bumps, bulges, juttings, protuberances, knobs, castellations, and/or other like features extending outwardly from the outer surface of the gripping ring 60/70. Moreover, a gripping ring 60/70 may also include dimples, slots, grooves, channels, rows, craters, bowls, and/or other like features extending inwardly from the outer surface of the gripping ring 60/70.

Embodiments of a connector 100 may comprise means for enhancing the surface friction pertinent to a portion 44*b* of the external surface of the connector body 40 intermediate the first 60 and second 70 gripping rings. Such means may include friction-enhancing surface features 50 positioned to increase friction of the surface of the connector body 40 helping to provide an improved grip-ability of the connector 100. In other words, the means may boost the amount of force necessary to slide the connector 100 out from a user's grip engaging the surface of the connector body 40 between gripping rings 60/70.

A method for fastening an RCA-type connector 100 to an interface port 20 is now described with reference to FIGS. 1-4. A RCA-type connector 100 may be provided, wherein the connector 100 includes a mating end 102 and opposing cable insertion end 104, and a connector body 40 having an external surface upon which a first gripping ring 60 and a second gripping ring 70 are securely located, wherein a portion of the exterior surface of the connector body 40 includes friction-enhancing surface features 50 located between the first 60 and second 70 gripping rings. Moreover, a coaxial cable 10 may be prepared for connector 100 attachment. Preparation of the coaxial cable 10 may involve removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. Various other preparatory configurations of coaxial cable 10 may be employed for use with connector 100 in accordance with standard broadband communications technology and equipment. For example, the protective outer jacket 12 may be folded over and drawn back along with the conductive grounding sheath 14 exposing a portion of the dielectric 16.

With continued reference to FIGS. 1-4 a method for fastening an RCA-type connector 100 to an interface port 20 is further described. A prepared cable 10 may be securely fastened to the cable insertion end 102 of the connector 100. Such fastening may include the snug placement of the cable 10 within the insertion end 104 and may further provide a substantially uniform circular distribution of grasping force on the cable 10 facilitating a secure and substantially sealed binding of the cable 10 to the connector 100 keeping out electromagnetic and/or other environmental contaminants.

Fastening of the connector 100 may be further attained by gripping the connector 100 so as to engage the gripping rings 60/70 and the friction-enhancing surface features 50. Gripping may be effectuated by physical appendages of a human operator and/or by inanimate objects comprising tools or portions thereof. For example, a human operator may place fingers and/or a thumb into engagement with the friction-enhancing surface features 50. Such placement of appendages may also entail engagement with one or more of the gripping rings, such as gripping rings 60/70. Where the appendages are placed in contact with the friction-enhancing surface features 50 and between the gripping rings 60/70, the operator may achieve an improved grip on the connector 100. In other words, the gripping the connector 100 on the friction-enhancing surface features 50 and between the gripping rings 60/70 may boost the amount of force necessary to slide the connector 100 out from an operators grip or hold of the connector 100. It should be appreciated that grip-ability may similarly be improved by placing a tool (as opposed to and/or in addition to a human appendage) into engagement with the friction-enhancing surface features 50 located between the first gripping ring 60 and second gripping ring 70. The interaction of the friction-enhancing surface features 50 and/or the gripping rings 60/70 with a human appendage and/or tool may include increased resistance to slipping do to friction forces. As such, the connector 100 may be more surely gripped. Moreover, the gripping rings 60/70 may also be rubber-like to increase the friction coefficient of the externality of the connector 100 and boost the force necessary to cause a grip of the rings 60/70 to slip.

Further methodology for fastening an embodiment of the connector 100 and an RCA-type interface port 20 may include maneuvering an embodiment of the connector 100 onto an interface port 20 while maintaining a sure grip on the connector. As discussed supra, the sure grip may be assisted, enhanced, and/or facilitated by the gripping of the connector 100 on at least the intermediate section 44*b* of the connector body 40 so as to engage the friction-enhancing surface features. Maneuvering may include compressing the mating edge 36 of the shielding ring 30 of the connector 100 over the end of the interface port 20, as assisted by the chamfer 34. Such compressing may include an operator (human/or robotic) pushing the connector 100 initially onto the interface port 20 and then sliding the connector 100 over the external surface 24 of the interface port 20 to accommodate snug maneuvering and firm fastening of the shield 30 and ultimately the connector 100 onto the interface port 20.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An RCA-type connector comprising:

a mating end and opposing cable insertion end; and a connector body extending between the mating end and cable insertion end;

wherein a portion of an exterior surface of the connector body includes friction-enhancing surface features located between a first gripping ring and a second gripping ring, said first and second gripping rings being externally positioned on the connector body.

2. The RCA-type connector of claim 1, wherein the mating end includes a shielding ring.

3. The RCA-type connector of claim 2, wherein the shielding ring is partially segmented into flexible sections.

4. The RCA-type connector of claim 2, wherein the shielding ring includes a mating edge having an internal annular chamfer.

5. The RCA-type connector of claim 1, wherein in the friction-enhancing surface features protrude from the exterior surface of the connector body.

6. The RCA-type connector of claim 1, wherein the friction-enhancing surface features comprise knurling.

7. The RCA-type connector of claim 1, wherein each of the first and the second gripping rings has an axial width slightly larger than an axial width corresponding to the portion of the exterior surface of the connector body including friction-enhancing surface features.

8. The RCA-type connector of claim 1, wherein the first and second gripping rings are formed of rubber-like material.

9. A sure-grip RCA-type coaxial cable connector comprising:

a connector body having an external surface upon which at least two gripping rings formed of rubber-like material are securely located; and friction-enhancing surface features positioned upon at least a portion of the external surface of the connector body between at least two of the gripping rings.

10. The sure-grip RCA-type coaxial cable connector of claim 9, further including a shielding ring.

11. The sure-grip RCA-type coaxial cable connector of claim 10, wherein the shielding ring is partially segmented into flexible sections.

12. The sure-grip RCA-type coaxial cable connector of claim 10, wherein the shielding ring includes a mating edge having an internal annular chamfer.

13. The connector of claim 9, wherein in the friction-enhancing surface features protrude from the exterior surface of the connector body.

14. The connector of claim 9, wherein the friction-enhancing surface features comprise knurling.

15. The connector of claim 9, wherein each of the at least two gripping rings has an axial width slightly larger than an axial width corresponding to at least the portion of the exterior surface of the connector body having positioned thereon the friction-enhancing surface features.

16. A connector comprising:

an RCA-type mating end and an opposing cable insertion end;

a connector body having an external surface upon which at least a first gripping ring and a second gripping ring are securely located; and means for enhancing the surface friction pertinent to a portion of the external surface of the connector body intermediate the first and second gripping rings.

17. The connector of claim 16, wherein the mating end includes a shielding ring partially segmented into flexible sections and having a mating edge with an internal annular chamfer.

18. A method for fastening an RCA-type connector to an interface port, said method comprising:

providing a connector, including a mating end and opposing cable insertion end, and a connector body having an external surface upon which a first gripping ring and a second gripping ring are securely located, wherein a portion of the exterior surface of the connector body includes friction-enhancing surface features located between the first and second gripping rings;

securely fastening a coaxial cable to the cable insertion end;

gripping the connector so as to engage the gripping rings and the friction-enhancing surface features; and maneuvering the connector onto an interface port while maintaining a sure grip on the connector.

19. The method of claim 18, wherein the first and second gripping rings are formed of rubber-like material.

20. The method of claim 18, wherein the connector further includes a shielding ring having flexible segments and an internal chamber chamfer upon a mating edge so that the ring fits snugly over the interface port as the connector is maneuvered thereon.

* * * * *

UNITED STATES PATENT AND TRADEMARK OFFICE

CERTIFICATE OF CORRECTION

PATENT NO. : 7,462,068 B2
APPLICATION NO. : 11/695666
DATED : November 19, 2008
INVENTOR(S) : Jeremy Amidon It is certified that error appears in the above-identified patent and that said Letters Patent is hereby corrected as shown below:

Column 3

Line 12, delete “preventingress” and insert -- prevent ingress --

Signed and Sealed this

Tenth Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,462,068 B2
APPLICATION NO. : 11/695666
DATED : December 9, 2008
INVENTOR(S) : Jeremy Amidon It is certified that error appears in the above-identified patent and that said Letters Patent is hereby corrected as shown below:

Column 3

Line 12, delete "preventingress" and insert -- prevent ingress --

This certificate supersedes the Certificate of Correction issued March 10, 2009.

Signed and Sealed this

Thirty-first Day of March, 2009

John Doll

JOHN DOLL
*Acting Director of the United States Patent and Trademark Office*